US006106219A

United States Patent [19]

Newsome et al.

[11] Patent Number: 6,106,219

[45] Date of Patent: Aug. 22, 2000

[54] STACK FORMING AND CONVEYING APPARATUS

[75] Inventors: John Robert Newsome, Shumway; Kenneth Jerome Polarek, Effingham, both of Ill.

[73] Assignee: John Robert Newsome, Shumway, Ill.

[21] Appl. No.: 09/233,554

[22] Filed: Jan. 20, 1999

[51] Int. Cl.[7] ..... B65G 57/06

[52] U.S. Cl. ..... 414/790.6; 198/468.1; 414/790.3; 414/794.2

[58] Field of Search ..... 198/468.1, 469.1, 198/479.1; 414/790.3, 790.6, 793.9, 794.2

[56] References Cited

U.S. PATENT DOCUMENTS

| | | | |
|---|---|---|---|
| 3,057,456 | 10/1962 | Heinzer . | |
| 3,122,242 | 2/1964 | Lopez et al. | 414/790.3 X |
| 3,205,794 | 9/1965 | Califano et al. | 414/790.6 X |
| 3,545,596 | 12/1970 | Turnbough . | |
| 3,944,057 | 3/1976 | Schuette et al. . | |
| 4,019,624 | 4/1977 | Torres . | |
| 4,029,194 | 6/1977 | Feurstein et al. | 198/468.1 X |
| 4,103,785 | 8/1978 | Wiseman | 414/790.3 X |
| 4,229,134 | 10/1980 | Reist . | |
| 4,357,126 | 11/1982 | Kidd et al. . | |
| 5,052,546 | 10/1991 | Langen et al. . | |
| 5,213,198 | 5/1993 | Kovacs . | |
| 5,238,120 | 8/1993 | Ballestrazzi et al. . | |
| 5,314,057 | 5/1994 | Calvert et al. . | |
| 5,350,055 | 9/1994 | Lecrone . | |
| 5,501,318 | 3/1996 | Disrud . | |
| 5,507,615 | 4/1996 | Uno | 414/790.3 X |

FOREIGN PATENT DOCUMENTS

| | | | |
|---|---|---|---|
| 99760 | 4/1962 | Norway | 414/793.9 |
| 2 268 147 | 1/1994 | United Kingdom . | |

*Primary Examiner*—Janice L. Krizek
*Attorney, Agent, or Firm*—Alston & Bird LLP

[57] ABSTRACT

An apparatus for forming and conveying stacks of documents includes a stacking machine positioned above a conveying machine. The stacking machine includes a compartment for receiving documents to be stacked. Two rotor assemblies are rotated in opposite directions to repeatedly define a closed configuration in which the documents are stacked within the compartment, and an open configuration in which a stack is dropped from the rotor assemblies to the conveying machine. The conveying machine includes a support surface upon which the stacks are sequentially dropped, and a pusher assembly for moving the stacks along the support surface. The pusher assembly includes two chain assemblies that travel around similar yet offset travel paths and carry multiple pusher bars. Each pusher bar is pivotally connected to both chain assemblies such that the pusher bars define a continuous pusher travel path, and the pusher bars remain generally upright around the entire pusher travel path. In a sequential fashion, a portion of each of the pusher bars moves from below the support surface to above the support surface, and thereafter along and above the support surface to push a stack along the support surface. The rotor assemblies and pusher bars are driven by servomotors. The servomotors provide for rapid and intermittent movement of the rotor assemblies and pusher bars, so that the interaction therebetween can be optimized in a manner that permits the apparatus to be reliably operated at a high delivery speed.

21 Claims, 5 Drawing Sheets

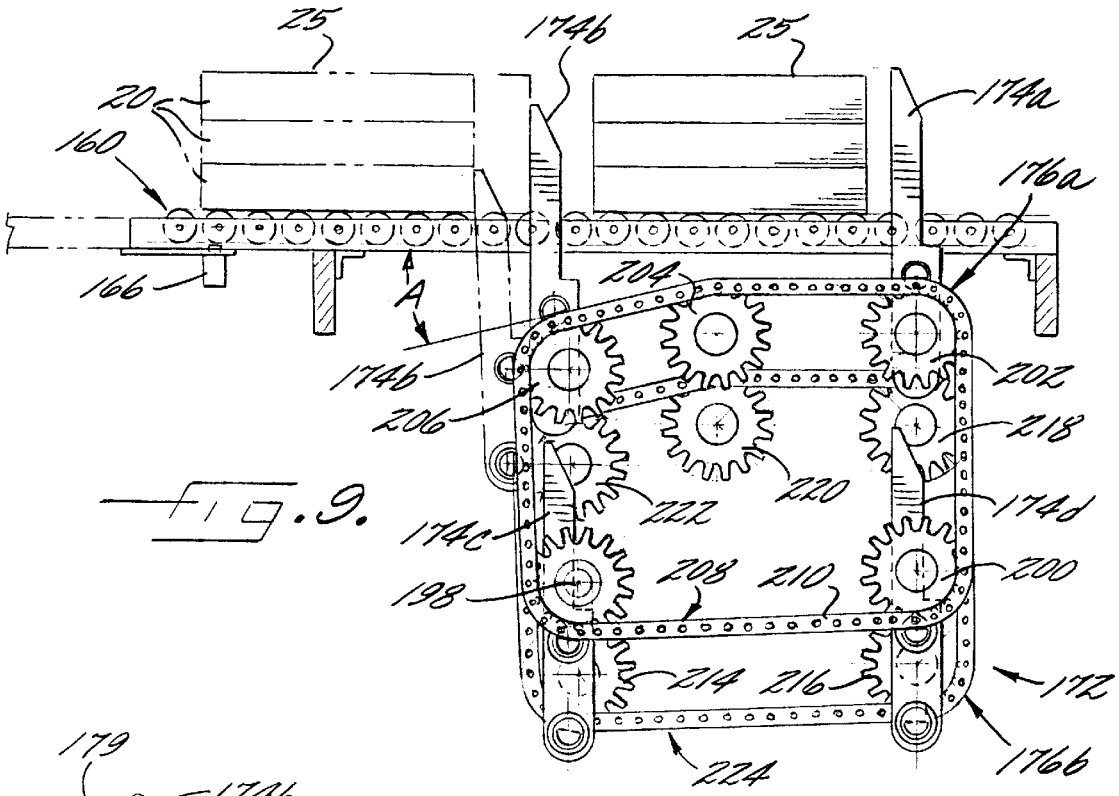
Fig. 9.
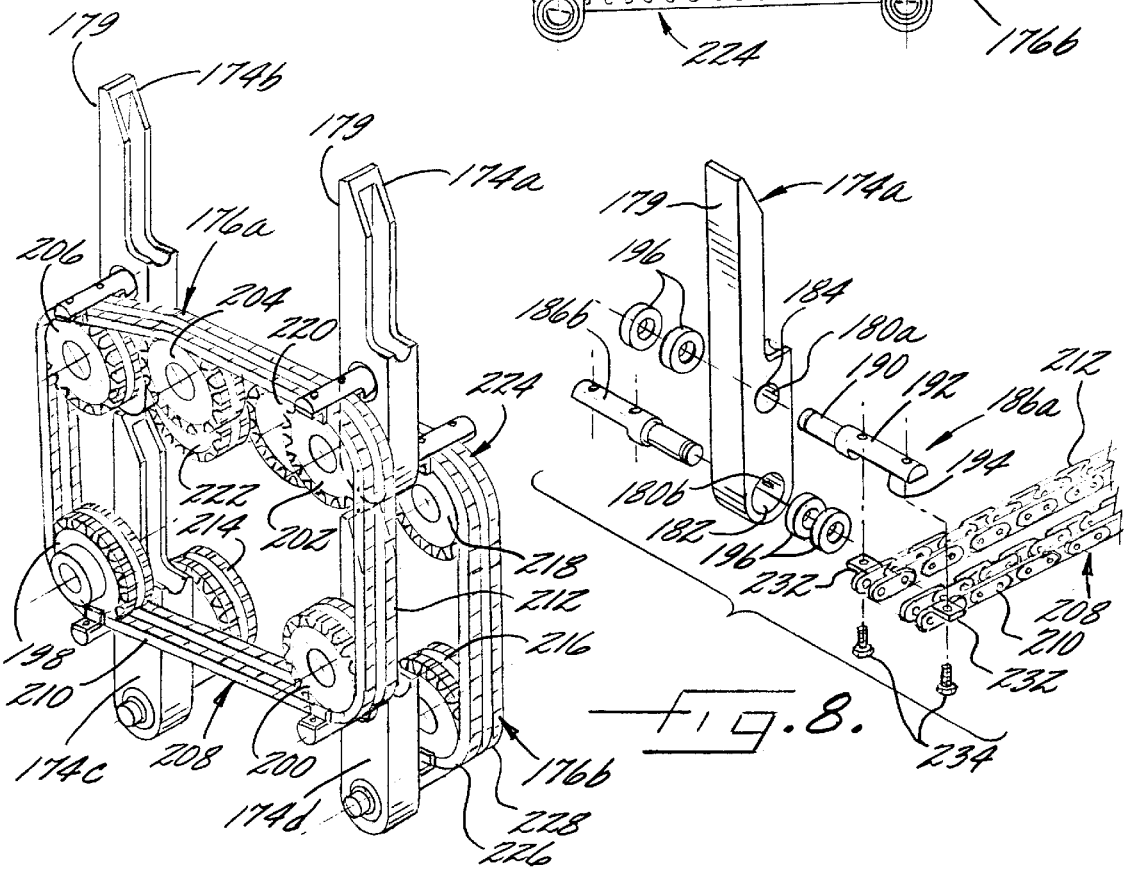
Fig. 8.
Fig. 7.

STACK FORMING AND CONVEYING APPARATUS

BACKGROUND OF THE INVENTION

The present invention relates to an apparatus for forming and conveying stacks of documents at a high speed.

Apparatus for forming and conveying stacks of documents are well known. For example, U.S. Pat. No. 4,229,134 to Reist discloses a prior apparatus for forming and conveying stacks of documents. The Reist patent discloses a vertical stacker compartment into which printed documents are dropped. Two displaceable slide plates are located at the bottom of the stacker compartment. The slide plates may be "closed" and "opened" to form and then drop a stack of printed documents through a receiver chute and onto an underlying support table. The stack is then ejected from the support table by means of an ejection element, which is guided by rollers along a horizontal path across the support table. At the end of the ejection stroke, the ejection element is retracted in the reverse direction along the support table. The ejection element is driven and retracted by means of a piston-and-cylinder unit.

In another known apparatus for forming and conveying stacks of documents, the vertical stacker compartment is defined between a pair of upright and slotted partitions. Each partition is positioned between a horizontal shaft and the stacker compartment. A single row of spaced apart fingers protrude radially from each of the shafts. The shafts are rotated in opposite directions so that the fingers protrude into the stacker compartment, so that a stack may be formed on the fingers in the stacker compartment. The shafts are then further rotated in the opposite directions so that the formed stack is dropped onto a support table beneath the stacker compartment. The cycle is repeated to produce subsequent stacks. During cycling of the shafts, the fingers pass through the slots in the partitions that define the stacker compartment. The formed stacks are ejected from the support table by an ejection element that is driven across the support table and then retracted by means of a piston-and-cylinder unit.

The operating speed of prior apparatus for forming and conveying stacks of documents is limited. For example, the back and forth movement of ejection elements limits the speed at which stacks of documents may be ejected.

It is accordingly an object of the present invention to provide an apparatus for forming and conveying stacks of documents that is capable of operating at speeds significantly higher than existing machines, while maintaining a high degree of reliability and properly delivering stacks of documents. It is also an object of the present invention to provide an apparatus for forming and conveying stacks that requires less maintenance than existing machines, and that is powered by electricity rather than requiring a pneumatic supply system.

SUMMARY OF THE INVENTION

The above and other objects and advantages of the present invention are achieved by the provision of an apparatus for forming and conveying stacks of documents, which comprises a rapidly operating stacking machine positioned above a rapidly operating conveying machine.

Stated generally, the stacking machine has a compartment capable of sequentially receiving the documents to be stacked. A stacking mechanism forms the bottom of the compartment and is operative to provide a closed configuration which a stack of the documents is capable of being formed within the compartment. The stacking mechanism is further operative to provide an open configuration in which a stack of documents formed within the compartment is capable of dropping from the compartment.

Stated generally, the conveying machine includes a support surface onto which stacks from the stacking machine are sequentially dropped. The conveying machine further includes an endless conveyor that is proximate to the support surface and defines a conveyor circuit. A plurality of pusher members are mounted in a spaced apart arrangement along the endless conveyor. The endless conveyor is sequentially advanced a predetermined distance around the conveyor circuit. Upon each sequential advance, one of the pusher members advances across the support surface to push away a stack that has been dropped onto the support surface from the stacking machine.

More specifically, the stacking mechanism includes two rotor assemblies that are rotated in opposite directions so that a first set of obstructing portions of the rotor assemblies rotate into the compartment to provide the closed configuration. The rotor assemblies remain in the closed configuration until a stack of the documents is formed on the first set of obstructing portions of the rotor assemblies. Thereafter, the rotor assemblies are further rotated so that the first set of obstructing portions are rotated at least partially away from the compartment to provide the open configuration, in which the stack of documents is dropped from the compartment. The rotor assemblies do not remain in the open configuration, but proceed directly to a subsequent closed configuration. A second set of obstructing portions of the rotor assemblies rotate into the compartment to provide the subsequent closed configuration. This process continues so that the stacking machine sequentially creates and drops stacks of documents.

The rotor assemblies are driven by a drive assembly that includes a servomotor. The servomotor quickly cycles the rotor assemblies, and is further operative to temporarily hold the rotor assemblies in the closed configurations during each cycle, so that stacks of documents are formed. The fact that a servomotor is utilized to rotate the rotor assemblies permits the apparatus to be reliably operated at high-delivery speeds.

A first of the rotor assemblies is rotated approximately 180 degrees clockwise between the closed configurations, whereas a second of the rotor assemblies is rotated approximately 180 degrees counterclockwise between the closed configurations. For each of the rotor assemblies, an open configuration follows each of the closed configurations by approximately 90 degrees.

For each of the rotor assemblies, the obstructing portions are defined by a plurality of fingers that extend radially from the axis of rotation of the rotor assembly. The compartment in which the documents are stacked is partially defined by a pair of partitions, each of which defines slots through which fingers of the rotor assemblies pass as the rotor assemblies are rotated.

Referring to the conveying machine more specifically, the endless conveyor includes two chain assemblies that are driven by a drive assembly so that each of the chain assemblies travels around a different travel path. Those travel paths are identical except that they are offset. Multiple pusher bars are carried by the chain assemblies so that the pusher bars travel around a continuous pusher travel path. Each of the pusher bars is pivotally connected to both of the chain assemblies in a manner such that the pusher bars remain upright around the entire pusher travel path.

The pusher travel path is defined so that, in a sequential fashion, a portion of each of the pusher bars moves from below the support surface to above the support surface, and thereafter along the support surface so that each of the pusher bars is operative for pushing a stack along the support surface. The support surface defines an elongate slot through which the pusher bars travel as they push stacks along the support surface.

The endless conveyor of the conveying machine is driven by a servomotor. The fact that a servomotor is utilized to move the endless conveyor, and therefore pusher bars, permits the apparatus to be reliably operated at a high delivery speed. The servomotor is operated intermittently to control the position of the pusher bars with respect to a receiving area of the support surface, which is where the stacks are dropped from the stacking machine onto the support surface. A pusher bar is positioned to the side of the receiving area and remains stationary until a stack is dropped onto the receiving area. Once a stack is dropped, the pusher bars are moved so that the pusher bar at the side of the receiving area pushes the newly dropped stack across the receiving area, and another pusher bar moves toward the receiving area.

Stated briefly, the servomotors of the apparatus provide for rapid and intermittent movement of the rotors and pusher bars, so that the interaction therebetween can be optimized in a manner that permits the apparatus to be reliably operated at a high delivery speed.

BRIEF DESCRIPTION OF THE DRAWINGS

Some of the objects and advantages of the present invention having been stated, others will become apparent as the description proceeds, when taken in conjunction with the accompanying drawings, in which:

FIG. 7 is an isolated perspective view of a pusher assembly of the apparatus of FIG. 1;

FIG. 8 is a perspective exploded view of selected components of the pusher assembly of FIG. 7; and FIG. 9 is a side elevation view of the pusher assembly interacting with a stack of documents upon a conveyor of the apparatus of FIG. 1.

DETAILED DESCRIPTION OF THE PREFERRED EMBODIMENT

The present invention now will be described more fully hereinafter with reference to the accompanying drawings, in which a preferred embodiment of the invention is shown. This invention may, however, be embodied in many different forms and should not be construed as limited to the embodiment set forth herein; rather, this embodiment is provided so that this disclosure will be thorough and complete, and will fully convey the scope of the invention to those skilled in the art. Like numbers refer to like elements throughout.

Figure 1:
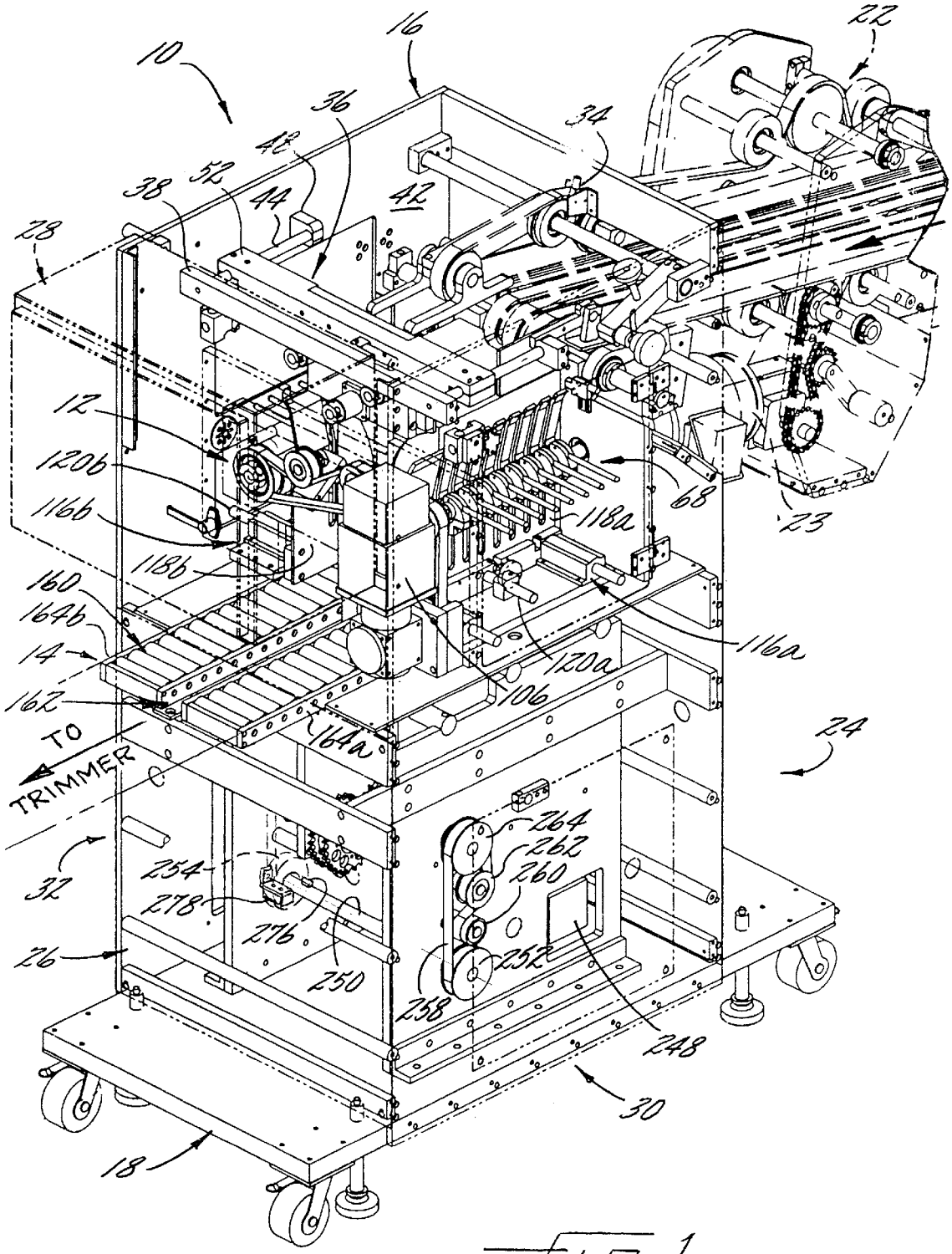
FIG. 1 is a perspective view of an apparatus for forming and conveying stacks of documents, with parts removed for improved visibility, in accordance with the present invention.
Figure 2:
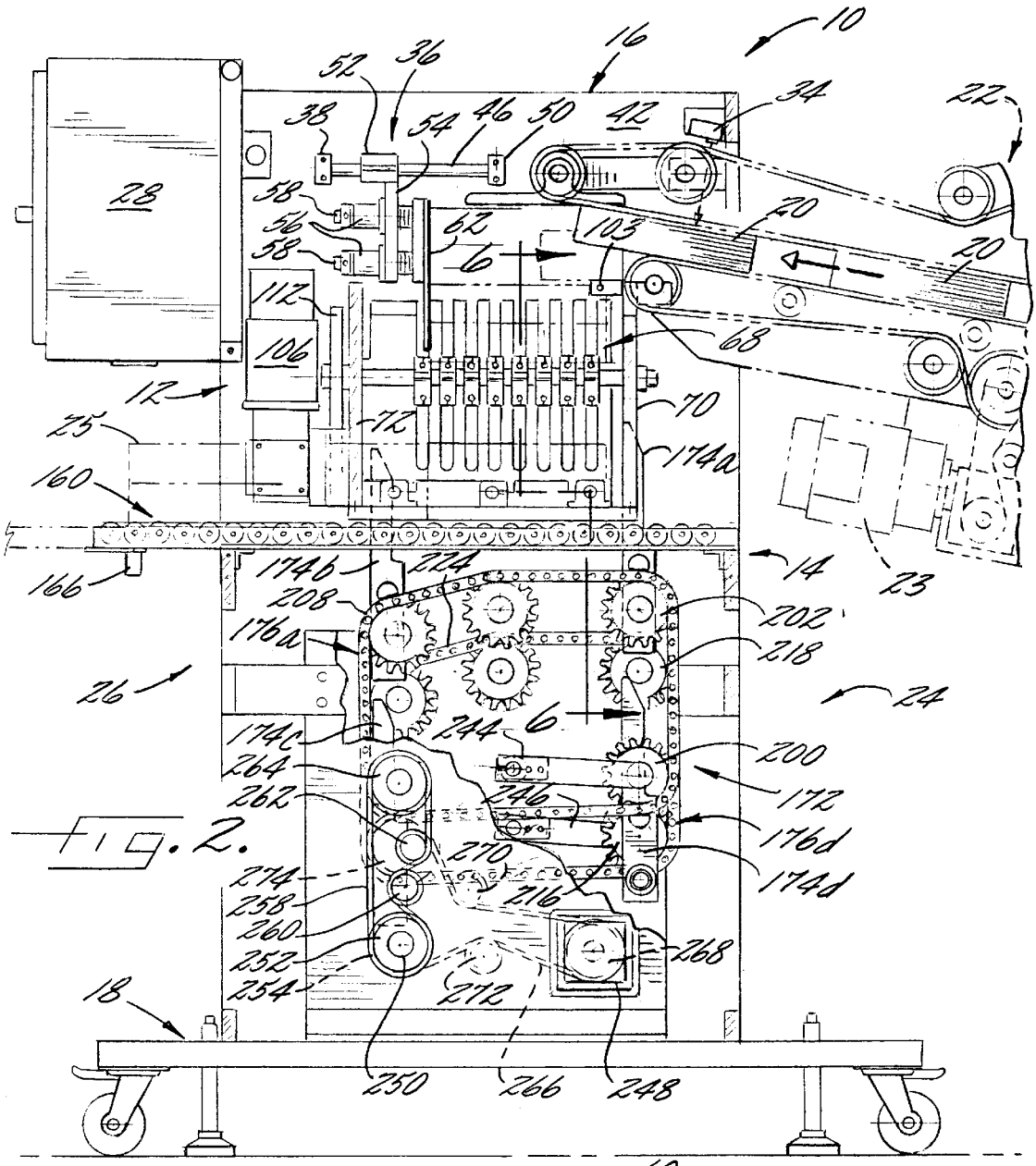
FIG. 2 is a side elevation view of the apparatus of FIG. 1, with parts cut away for improved visibility.

Referring more particularly to the drawings, an apparatus for forming and conveying stacks of documents is indicated generally at 10. As best seen in FIGS. 1 and 2, the apparatus 10 includes a stacking machine 12 that is positioned above a conveying machine 14. The apparatus 10 further includes a frame assembly 16 that is integrated with and supports the stacking machine 12 and the conveying machine 14. The frame assembly 16 extends upward from a wheeled base 18.

As will be discussed in greater detail below, documents 20 (FIG. 2) are provided to the stacking machine 12 by a belt conveyor 22, which is illustrated in broken lines in FIGS. 1 and 2. The belt conveyor 22 includes several belts that are driven by a variable speed drive 23 so that documents 20 can be sequentially provided to the stacking machine 12 in an uninterrupted fashion. The belt conveyor 22 is conventional, except for the manner in which the operation of the drive 23 is coordinated with the operation of the apparatus 10, as will be discussed in greater detail below.

The drive 23 is preferably programmable and has a power rating of at least 36 inch pounds of torque. In one specific example, a drive manufactured by Reliance Electrocraft as Premium Model P14G has proven to be very satisfactory.

The operations of the stacking machine 12 and the conveying machine 14 are controlled and coordinated by a control assembly, part of which may be contained within a control box 28 (FIG. 2). The operation of the stacking machine 12 and the conveying machine 14 will now be briefly described. The documents 20 are introduced by the conveyor 22 into a rear side 24 of the stacking machine 12. The documents 22 are formed into a stack 25 (FIGS. 2, 6A, 6B and 9) within the stacking machine 12, and thereafter the stack is dropped to the conveying machine 14. The stacking machine 12 sequentially forms and drops stacks 25 to the conveying machine 14. The stacks 25 are sequentially conveyed out of a front side 26 of the conveying machine 14. A stack 25 must be conveyed out of the front side 26 of the conveying machine 14 prior to the subsequent stack being dropped to the conveying machine.

As best seen in FIG. 1, the apparatus 10 includes a right side 30 and a left side 32, in addition to the previously mentioned front side 26 and rear side 24. So as to provide a frame of reference for the purpose of clarifying this disclosure, a longitudinal direction is defined from the front side 26 to the rear side 24, and vice versa. Similarly, a lateral direction is defined from the right side 30 to the left side 32, and vice versa.

The components of the stacking machine 12 will now be discussed in greater detail. The stacking machine 12 includes a counting sensor 34 mounted to the frame assembly 16. The sensor 34 is mounted just above an opening, which is defined by the frame assembly 16, through which documents 20 are introduced to the stacking machine 12 by the belt conveyor 22.

The sensor 34 includes an optical eye that views a mirror (not shown) positioned below the belt conveyor 22. The mirror is seen by the optical eye through a space defined between belts of the conveyor 22. The sensor 34 functions to count the number of documents 20 passing from the conveyor 22 to the stacking machine 12, and each time a predetermined number of documents is counted, a signal from the sensor 34 triggers the stacking machine 12 to cycle from one closed configuration to the next, as will be discussed in greater detail below. That signal also causes the conveying machine 14 to cycle, as will be discussed in greater detail below.

Figure 3:
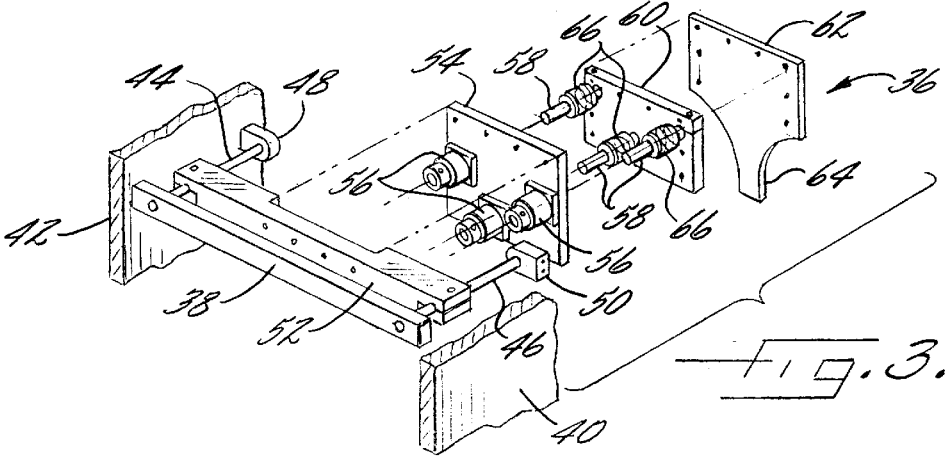
FIG. 3 is a generally isolated, exploded perspective view of a deflection assembly of the apparatus of FIG. 1.

After a document 20 is introduced to the stacking machine 12, the document typically encounters a deflection assembly 36, which is best seen with reference to FIG. 3. A laterally extending support shaft 38 is rigidly mounted between a right partition 40 of the frame assembly 16 (FIGS. 1 and 2) and a left partition 42 of the frame assembly. Mounting brackets 48, 50 are also respectively mounted to the left partition 42 and the right partition 40. Adjustment rods 44, 46 are mounted between the support shaft 38 and the mounting brackets 48, 50, respectively. A selectively mobile adjustment shaft 52 has opposite split ends that are carried by the adjustment rods 44, 46. Each of the split ends of the adjustment shaft 52 can be loosened, such as by operating an associated screw or bolt, or the like, to allow the adjustment shaft 52 to be manually moved along the adjustment rods 44, 46. The split ends of the adjustment shaft 52 can be tightened to immobilize the adjustment shaft with respect to the adjustment rods 44, 46.

A base plate 54 is mounted to a recess in the adjustment shaft 52. Collar assemblies 56 are mounted to the rear of the base plate 54. Rods 58 extend through holes in the base plate 54 and are loosely carried by the collar assemblies 56. The ends of the rods 58 that are opposite from the collar assemblies 56 are mounted to an intermediate plate 60, onto which a contact plate 62 is mounted. The contact plate 62 includes a tapered section 64 that extends below the intermediate plate 60.

Separate spring assemblies 66 encircle each of the rods 58. The spring assemblies 66 are positioned between the intermediate plate 60 and the base plate 54. When a heavy document 20 (FIG. 2) contacts the rearward facing surface of the contact plate 62 upon being introduced to the stacking machine 12 (FIGS. 1 and 2), the contact plate and intermediate plate 60 may momentarily move toward the base plate 54 and then rebound under the influence of the spring assemblies 66. The longitudinal position of the contact plate 62 can be adjusted by moving the adjustment shaft 52 along the adjustment rods 44, 46, so as to compensate for different sizes of documents 20.

Figures 4, 5:
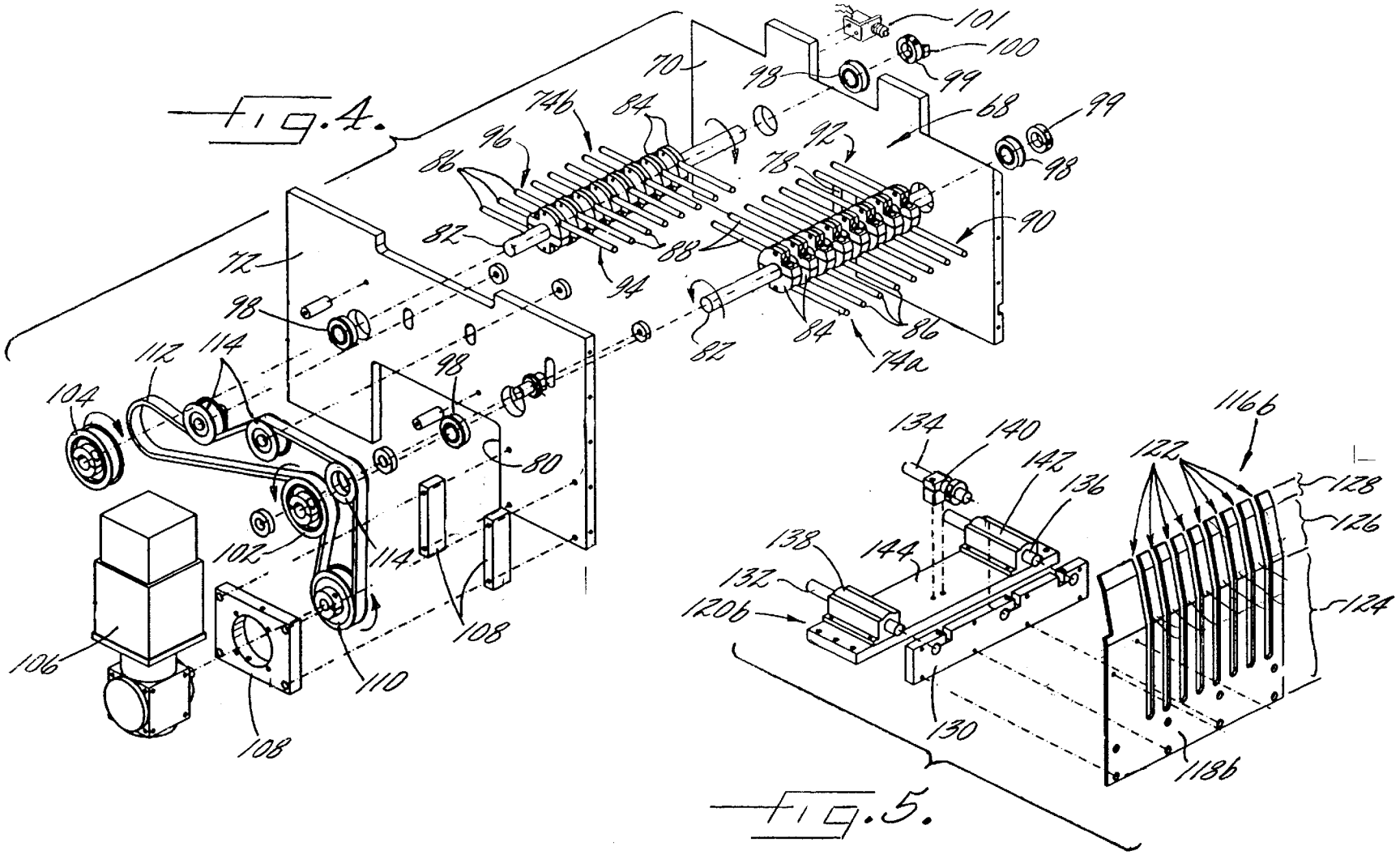
FIG. 4 is a perspective exploded view of a stacking mechanism, and drive assembly therefor, of the apparatus of FIG. 1.
FIG. 5 is an isolated, exploded perspective view of a guide assembly of the apparatus of FIG. 1.

A stacking mechanism 68 of the stacking machine 12 (FIGS. 1 and 2) is best seen in FIG. 4. The stacking mechanism 68 includes a laterally extending rear support plate 70 and a laterally extending forward support plate 72, both of which are rigidly mounted between components of the frame assembly 16 (FIGS. 1 and 2). The rear support plate 70 defines an elongate upright slot 78 through which a portion of the conveying machine 14 (FIGS. 1 and 2) passes, as will be discussed in greater detail below. The forward support plate 72 defines an opening 80 through which stacks 25 (FIG. 2) and a portion of the conveying machine 14 pass, as will be discussed in greater detail below.

Figure 6A:
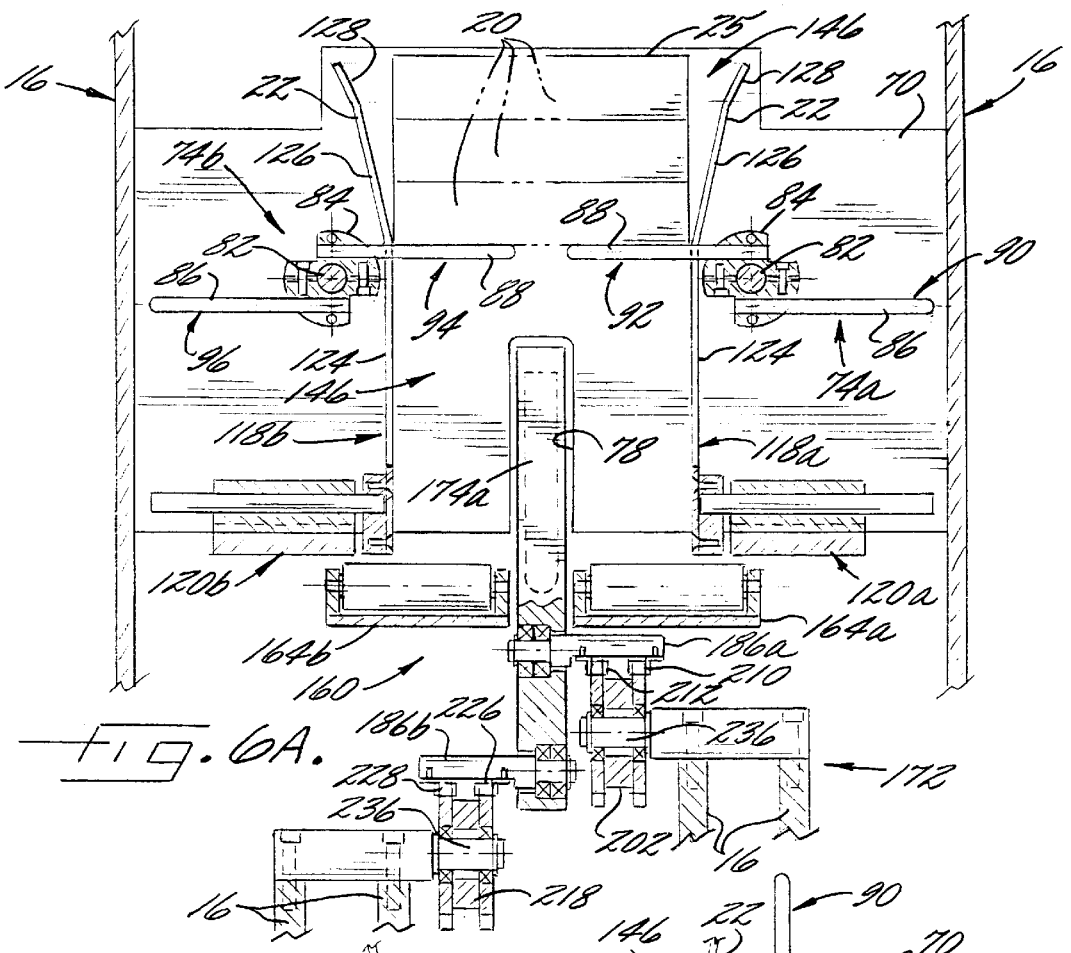
FIG. 6A is a sectional view of a portion of the apparatus of FIG. 1, taken substantially along line 6—6 of FIG. 2, while the apparatus is in a closed configuration.

As best seen in FIG. 4, a right rotor assembly 74*a* and a left rotor assembly 74*b* are rotatably mounted between the support plates 70, 72. The rotor assemblies 74*a*, 74*b* are similarly constructed. Each rotor assembly 74*a*, 74*b* includes a longitudinally extending shaft 82. A longitudinally extending axis of rotation of the rotor assembly 74*a* is coaxial with the longitudinal axis of the shaft 82 of the rotor assembly 74*a*. A longitudinally extending axis of rotation of the rotor assembly 74*b* is coaxial with the longitudinal axis of the shaft 82 of the rotor assembly 74*b*. Multiple split collars 84 are rigidly mounted to the shafts 82 at uniform spaced intervals. A finger 86 and a finger 88 are mounted to each split collar 84, so that each of the rotor assemblies 741, 74*b* includes two rows of fingers. Two representative split collars 84 are best seen in FIG. 6A. As illustrated in FIG. 6A, when the fingers 86, 88 extend horizontally, the fingers 86 are higher than the fingers 88.

As illustrated in FIG. 4, all of the fingers 86 of the right rotor assembly 74*a* extend in a common plane and can be characterized as cooperating to define an obstructing partition 90. Likewise, all of the fingers 88 of the right rotor assembly 74*a* extend in a common plane and can be characterized as cooperating to define an obstructing partition 92. Similarly, all of the fingers 88 of the left rotor assembly 74*b* extend in a common plane and can be characterized as cooperating to define an obstructing partition 94, and all of the fingers 86 of the left rotor assembly extend in a common plane and can be characterized as cooperating to define an obstructing partition 96.

The rear ends of the shafts 82 extend through openings in the rear support plate 70, and also through respective bearings 98 and collars 99. The collars 99 rotate with their respective shafts 82. The collar 99 on the rear end of the shaft 82 of the left rotor assembly 74*b* includes a pair of cams 100 that cooperate with a sensor 101. The sensor 101 is mounted to the rear surface of rear support plate 70. Only one of the cams 100 is seen in FIG. 4, but the cams 100 are on opposite sides of their collar 99. Thus, one of the cams 100 becomes proximate to the sensor 101 each time the rotor assembly 74*b* rotates 180 degrees.

The sensor 101 is a proximity probe that cooperates with the cams 100 to provide a signal each time the rotor assembly 74*b* rotates 180 degrees. When a signal is received from the sensor 100, rotation of the rotor assemblies 74*a*, 74*b* is temporarily terminated so that the fingers 86, 88 extend horizontally.

A sensor 103 (FIG. 2) is mounted to the upper front surface of the rear support plate 70. Sensor 103 includes a optical eye that views a mirror (not shown) that is positioned horizontally across the stacking mechanism 68 from the sensor 103, so that the sensor 103 can generate a signal in response to too many documents 20 (FIG. 2) being within the stacking mechanism 68. In response to that signal, the entire apparatus 10 (FIGS. 1 and 2) and the conveyor 22 (FIGS. 1 and 2) are shut down.

As best seen in FIG. 4, the front end of the shaft 82 of the right rotor assembly 74*a* extends through the forward support plate 72 and one of the bearings 98, and the terminus of that shaft carries a drive pulley 102. Similarly, the front end of the shaft 82 of the left rotor assembly 74*b* extends through the forward support plate 72 and one of the bearings 98, and the terminus of that shaft carries a drive pulley 104.

A drive assembly 105, which causes the rotor assemblies 74*a*, 74*b* to rotate in opposite directions, includes a servomotor 106 that is mounted to the forward support plate 72 by mounting components 108. A drive pulley 110 is carried by the output shaft of the servomotor 106. A drive belt 112 extends around the drive pulleys 102, 104, 110 and three idler pulleys 114. When viewed from the front 26 (FIGS. 1 and 2), the drive pulley 110 mounted to the output shaft of the servomotor 106 is rotated counterclockwise, and the drive belt 112 is arranged so that the drive pulley 104 and the left rotor assembly 74*b* rotate clockwise, and the drive pulley 102 and the right rotor assembly 74*a* rotate counterclockwise.

As will be discussed in greater detail below, operation of the servomotor 106, and the resultant rotation of the rotor assemblies 74*a*, 74*b*, is triggered by the signal from the sensor 34 (FIG. 2). Cessation of the operation of the servomotor 106, and the corresponding cessation of the rotation of the rotor assembly 74*a*, 74*b*, is triggered by the sensor 101.

The servomotor 106 is preferably programmable and has a power rating of at least 30 inch pounds of torque, and the capability of starting and stopping at a rate of about 10 times a second. As one specific example, a servomotor manufactured by Reliance Electrocraft as Model No. H430P has proven to be very satisfactory.

As best seen in FIG. 1, the stacking machine 12 further includes a right guide assembly 116*a* and a left guide assembly 116*b*. The guide assemblies 116*a*, 116*b* respectively include guide partitions or plates 118*a*, 118*b* and guide adjusters 120*a*, 120*b*. The guide assemblies 116*a*, 116*b* are identical, except for being oppositely oriented, as illustrated in FIG. 1. Therefore, the following detailed discussion of the left guide assembly 116*b* should be understood to be representative of the right guide assembly 116*a*.

As best seen in FIG. 5, the guide plate 118*b* defines multiple slots 122 that are open at the top of the guide plate. More specifically, the slots 122 originate in a lower section 124 and extend through an intermediate section 126 and an upper section 128 of the guide plate 118*b*. As best illustrated in FIG. 6A, the lower sections 124 of the guide plates 118*a*, 118*b* extend approximately vertically, the intermediate sections 126 of the guide plates extend at approximately 15 degrees with respect to the vertical, and the upper sections 128 of the guide plates extend at approximately 30 degrees with respect to the vertical.

As best seen in FIG. 5, the guide assembly 116*b* includes a longitudinally extending support plate 130 to which rods 132, 134, 136 are perpendicularly mounted. The rods 132, 134, 136 are respectively encircled by an elongate collar 138, a split collar 140 and an elongate collar 142. Each of the collars 138, 140, 142 are mounted to a base plate 144 that is mounted to the frame assembly 16 (FIGS. 1 and 2). The position of the guide plate 118*b* can be adjusted with respect to the base plate 144 by loosening the split collar 140, such as by operating a screw or bolt, or the like, of the split collar 140, so that the rods 132, 134, 136 can be moved within their collars 138, 140, 142. The guide plate 118*b* can be held stationary by tightening the split collar 140.

Figure 6B:
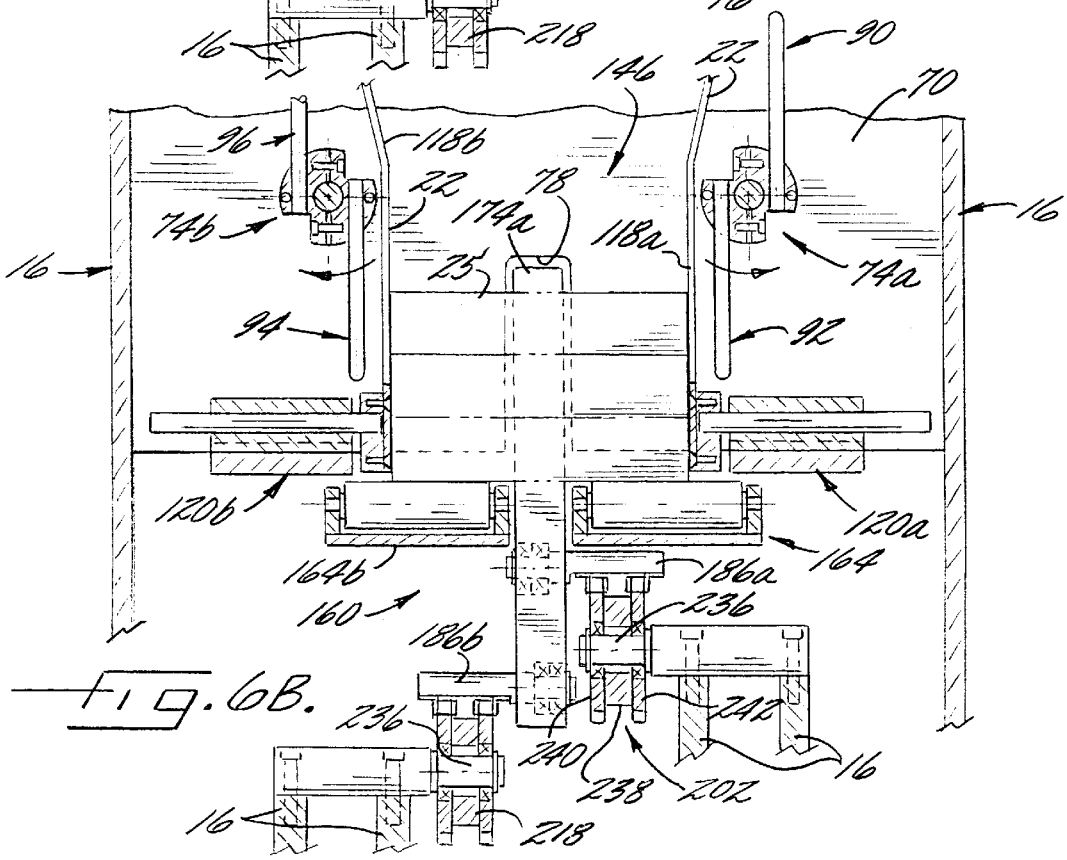
FIG. 6B is a view similar to that of FIG. 6A, except that the apparatus is in an open configuration.

As best illustrated in FIGS. 6A and 6B, a compartment 146 is defined between the guide plates 118*a*, 118*b*, the rear support plate 70 and the tapered section 64 (FIG. 3) of the contact plate 62 (FIGS. 2 and 3). The lower terminus of the tapered section 64 of the contact plate 62 preferably does not extend below the upper terminus of the slot 78 defined in the rear support plate 70. The intermediate sections 126 and upper sections 128 of the guide plates 118*a*, 118*b* define a funnel-shape that aids in the funneling of the documents 20 into the lower section of the compartment 146.

As oriented in FIG. 6A, each of the documents 20 defines a longitudinal width and a lateral width, both of which are in a horizontal plane. The positions of the guide plates 118*a*, 118*b* are preferably manually adjusted so that the lateral width defined between the guide plates in the lower section of the compartment 146 is just slightly greater than the lateral width of the documents 20. Similarly, the position of the contact plate 62 (FIGS. 2 and 3) is preferably manually adjusted so that the longitudinal width defined between the tapered section 64 (FIG. 3) of the contact plate 62 and the rear support plate 70 is just slightly greater than the longitudinal width of the documents 20.

The operation of the stacking mechanism 68 (FIG. 4) may be best understood with reference to FIGS. 6A and 6B. In FIG. 6A the rotor assemblies 74*a*, 74*b* are illustrated in a closed configuration, in which the obstructing partitions 92 and 94 extend in a common plane and into the compartment 146. In FIG. 6A, an upper section (i.e., stacking compartment) of the compartment 146 is above the obstructing partitions 92, 94, and a lower section (i.e., dropping compartment) of the compartment 146 is below the obstructing partitions 92, 94. The rotor assemblies 74*a*, 74*b* are maintained in the closed configuration until a stack 25 is formed upon the obstructing partitions 92, 94.

Once a stack 25 of a predetermined height is formed, the servomotor 106 (FIGS. 1, 2 and 4) is operated so that the right rotor assembly 74*a* rotates 90 degrees in one direction and the left rotor assembly 74*b* rotates 90 degrees in the opposite direction, so that the rotor assemblies are in an open configuration, which is illustrated in FIG. 6B. When the transition is made from the closed configuration to the open configuration, a stack 25 formed in the upper section of the compartment 146 falls to the lower section of the compartment. Stacks 25 within the lower section of the compartment 146 are conveyed out of the compartment in a manner that will described below.

The rotor assemblies 74*a*, 74*b* do not remain in the open configuration, but preferably pass quickly and without stopping through the open configuration as the rotor assemblies continuously travel 180 degrees from an initial closed configuration to a subsequent closed configuration. That is, the rotors 74*a*, 74*b* rotate between a first closed configuration in which the obstructing partitions 92, 94 extend in a common plane and into the compartment 146, and a second closed configuration in which the obstructing partitions 90, 96 extend into the compartment in the same common plane previously occupied by the obstructing partitions 92, 94. As the rotor assemblies 74*a*, 74*b* rotate between the closed configurations, the fingers 86, 88 of the rotor assemblies 74*a*, 74*b* pass through respective slots 22 (also see FIG. 5) in the guide plates 118*a*, 118*b*.

Referring to FIGS. 1 and 2, the components of the conveying machine 14 will now be discussed in greater detail. The conveying machine 14 includes a horizontally and longitudinally extending conveyor 160 that extends below the stacking machine 12. The conveyor 160 is neither powered nor endless in the preferred embodiment. Stacks 25 are sequentially dropped from the stacking mechanism 68 (FIG. 4) onto the upper surface of the conveyor 160, and thus that horizontally extending upper surface may be referred to as a support surface that supports the dropped stacks. More specifically, the stacks 25 are sequentially dropped onto a receiving area of the support surface, and that receiving area is directly below and aligned with the compartment 146 (FIGS. 6A and 6B).

A longitudinally extending, vertical slot 162 extends through the conveyor 160. More specifically, the conveyor 160 includes a right conveyor 164*a* and a left conveyor 164*b*. Each of the conveyors 164*a*, 164*b* includes laterally extending rollers that are rotatably mounted between longitudinally extending side rails. The slot 162 is defined between side rails of the conveyors 164*a*, 164*b*. As best seen in FIG. 2, a sensor 166 is mounted below the conveyor 160, and that sensor senses stacks 25 on the conveyor.

More specifically, the sensor 66 includes an optical eye that views a mirror (not shown) mounted on the bottom of the control box 28 through the vertical slot 162 in the conveyor 160. If the sensor 166 detects that a stack 25 is remaining stationary on the conveyor 160, such as might occur due to a jam of stacks downstream from the apparatus 10, the sensor 166 generates a signal. In response to that signal, operation of the apparatus 10 and the belt conveyor 22 is terminated.

As mentioned above, the conveyor 160 is preferably not directly "powered." Rather, the stacks 25 dropped onto the conveyor 160 by the stacking machine 12 (FIGS. 1 and 2) are propelled along the conveyor 160 by a pusher assembly 172, which is best seen in FIGS. 2, 7 and 9. A majority of the pusher assembly 172 is below the conveyor 160. As best seen in primarily in FIG. 7, the pusher assembly 172 includes pusher bars 174*a*, 174*b*, 174*c*, 174*d* that are connected to and driven by right and left drive systems 176*a*, 176*b*. The pusher bars 174*a*, 174*b*, 174*c*, 174*d* are connected to the drive systems 176*a*, 176*b* such that the pusher bars travel around a continuous loop-like travel path and remain generally upright while traveling around that travel path.

Each of the pusher bars 174*a*, 174*b*, 174*c*, 174*d* is identical; therefore, the details of one of the pusher bars should be considered representative of the other pusher bars. As best seen in FIG. 8, the pusher bar 174*a* includes a contact face 179. The contact face 179 is for contacting stacks 25 (FIGS. 2, 6A, 6B and 9) that are upon the conveyor 160 (FIGS. 1, 2 and 9). Laterally extending upper and lower openings 180*a*, 180*b* are defined through the pusher bar 174*a*, and those openings share a common vertical center line. Each of the openings 180*a*, 180*b* are identical, except that one is above the other and they are oppositely oriented. Each of the openings 180*a*, 180*b* includes a large diameter portion 182 open at one side of the pusher bar 174*a* and a smaller diameter portion 184 open at the opposite side of the pusher bar 174*a*.

A right shaft 186*a* extends into the upper opening 180*a*, and a left shaft 186*b* extends into the lower opening 180*b*. Each shaft 186*a*, 186*b* includes a small diameter portion 190 and a large diameter portion 192. Each large diameter portion 192 includes a flattened section 194. Bearings 196 are fit into the large diameter portions 182 of the openings 180*a*, 180*b*. The small diameter portions 192 of the shafts 186*a*, 186*b* are fit through the small diameter portions 184 of the openings 180*a*, 180*b* such that the shafts are carried by the bearings 196 within the large diameter portions 182.

As best illustrated in FIG. 7, the right drive system 176*a* includes a driven sprocket assembly 198 and idler sprocket assemblies 200, 202, 204, 206. The right drive system 176*a* further includes a chain assembly 208 that includes a right chain 210 and a left chain 212 that travel in unison around the sprocket assemblies 198, 200, 202, 204, 206. Similarly, the left drive system 176*b* includes a driven sprocket assembly 214 and idler sprocket assemblies 216, 218, 220, 222. The left drive system 176*b* further includes a chain assembly 224 that extends around the sprocket assemblies 214, 216, 218, 220, 222. The chain assembly 224 includes a right chain 226 and a left chain 228 that travel in unison. The pusher bars 174*a*, 174*b*, 174*c*, 174*d* are connected to and evenly spaced around the lengths of the chain assemblies 208, 224.

The chain assemblies 208, 224 can together be characterized as an endless conveyor that defines a conveyor circuit. The pusher bars 174*a*, 174*b*, 174*c*, 174*d* are mounted to the endless conveyor defined by the combination of the chain assemblies 208, 224 such that the pusher bars travel with the endless conveyor around the conveyor circuit.

Referring to FIG. 8 for example, each of the pusher bars 174*a*, 174*b*, 174*c*, 174*d* includes a right shaft 186*a* connected to the right chain assembly 208 and a left shaft 186*b* connected to the left chain assembly 224 (FIG. 7). The manner in which the right shaft 186*a* of the pusher bar 174*a* is attached to the right chain assembly 208 is representative of the manner in which the shafts 186*a*, 186*b* of each of the pusher bars 174*a*, 174*b*, 174*c*, 174*d* are connected to their respective chain assembly 208 or 224.

As best seen in FIG. 8, the chains 210, 212 of the right chain assembly 208 are each conventional link chains, except that they further include planar flanges 232 that are connected to and extend perpendicularly and in opposite directions from adjacent links. The flattened section 194 of the large diameter portion 192 of the right shaft 186*a* abuts the planer upper surfaces of the flanges 232. Screws or bolts pass through vertical openings in the flanges 232 and into vertical threaded openings in the right shaft 186*a*, so that the shaft 186*a* is mounted to the chain assembly 208.

Portions of the pusher assembly 172 are illustrated in the lower halves of FIGS. 6A and 6B. FIG. 6B illustrates the detailed construction of the sprocket assembly 202, which is generally representative of the construction of each of the sprocket assemblies 198, 200, 204, 206, 214, 216, 218, 220, 222 (FIGS. 7 and 8). The sprocket assembly 202 includes an annular spacer 238 that is sandwiched between an inner sprocket 240 and an outer sprocket 242, such that the inner and outer sprockets 240, 242 and spacer 238 rotate in unison. The sprocket assembly 202 is rotatably carried by a stationary shaft 236 that is mounted to portions of the frame assembly 16, and the idler sprocket assemblies 204, 206, 218, 220 and 222 are similarly mounted.

As best illustrated in FIG. 2, the idler sprockets 200 and 216 are rotatably carried by selectively movable tension adjustment assemblies 244, 246. The tension adjustment assemblies 244, 246 provide for manual adjustment to the tension of the chain assemblies 208, 224 (FIG. 7). The shafts that carry the driven sprocket assemblies 198, 214 are discussed in greater detail below.

As best seen in FIGS. 7 and 9, the drive systems 176*a*, 176*b* of the pusher assembly 172 are generally identical, except that they are offset from one another. That is, the left drive system 176*b* is laterally displaced from and slightly lower than the right drive system 176*a*. Referring primarily to FIG. 7, the right drive system 176*a* extends in a plane and the left drive system 176*b* extends in a plane that is parallel to the plane of the right drive system.

More specifically regarding the offset nature of the drive systems 176*a*, 176*b* of the pusher assembly 172, the chain assemblies 208, 224 each include an upper and lower run, and those runs are offset. That is, an upper run of the right chain assembly 208 spans between the sprocket assemblies 202 and 206. An upper run of the left chain assembly 224 spans between the sprocket assemblies 218 and 222. Those upper runs are generally parallel to and below the conveyor 160, and the upper run of the right chain assembly 208 is above the upper run of the left chain assembly 224. A lower run of the right chain assembly 208 spans between the sprocket assemblies 198 and 200. A lower run of the left chain assembly 224 spans between the sprocket assemblies 214 and 216. Those lower runs are generally parallel to and below the upper runs, and the lower run of the right chain assembly 208 is above the lower run of the left chain assembly 224.

Referring primarily to FIGS. 7 and 9, the right chain assembly 208 extends generally vertically between the sprocket assembly 200 and the sprocket assembly 202, and the left chain assembly 224 extends generally vertically between the sprocket assembly 216 and the sprocket assembly 218. The right chain assembly 208 extends approximately horizontally between the sprocket assembly 202 and the sprocket assembly 204, and the left chain assembly 224 extends approximately horizontally between the sprocket assembly 218 and the sprocket assembly 220. The right chain assembly 208 extends somewhat downward from the sprocket assembly 204 to the sprocket assembly 206 to define an acute angle "A" (FIG. 9) of approximately 15 degrees with respect to horizontal, and the left chain assembly 224 extends somewhat downward from the sprocket assembly 220 to the sprocket assembly 222 to define a similar acute angle of approximately 15 degrees with respect to horizontal. The right chain assembly 208 extends generally vertically between the sprocket assembly 206 and the sprocket assembly 198, and the left chain assembly 224 extends generally vertically between the sprocket assembly 222 and the sprocket assembly 214.

Referring to FIG. 1, the right and left drive systems 176*a*, 176*b* (FIGS. 7 and 8) are driven in unison by a servomotor 248 that drives a drive shaft 250. The drive shaft 250 carries drive pulleys 252 and 254 upon its opposite ends. The drive pulley 252 is part of a drive subassembly that further includes a drive belt 258 that extends around idler pulleys 260, 262 and a drive pulley 264. The drive pulley 264 shares a common shaft with the driven sprocket assembly 198 (FIGS. 7 and 9) so that rotation of the drive pulley 264 causes rotation of the driven sprocket assembly 198. Thus, operation of the servomotor 248 (FIGS. 1 and 2) causes the driven sprocket assembly 198 to drive the right chain assembly 208 (FIGS. 7 and 9).

The drive pulley 254 is hidden from view in FIG. 1, and is partially illustrated in broken lines. The remainder of a drive subassembly associated with the drive pulley 254 is also hidden from view in the figures of this disclosure. However, the remainder of the drive subassembly associated with the drive pulley 254 is shown in broken lines in FIG. 2. Referring to FIG. 2, a drive belt 266 that extends around the drive pulley 254 (FIG. 1) also extends around a drive pulley 268 mounted to the output shaft of the servomotor 248, idler pulleys 270, 272 and a drive pulley 274. The drive pulley 274 and the driven sprocket assembly 214 (FIGS. 7 and 9) are carried by a common shaft so that rotation of the drive pulley 274 causes rotation of the driven sprocket assembly 214. Thus, operation of the servomotor 248 (FIGS. 1 and 2) causes the driven sprocket assembly 214 to drive the left chain assembly 224 (FIGS. 7 and 9).

As best seen in FIG. 1, a cam 276 is mounted to and moves with the drive shaft 250 of the conveying machine 14. The drive shaft 250 rotates 360 degrees each time the pusher bars 174 (FIGS. 7–9) advance a predetermined distance. A sensor 278, which is mounted to the frame assembly 16 and preferably includes a proximity probe, detects the cam 276 each time the cam is rotated through 360 degrees. The sensor 278 generates a signal each time it detects the cam 276. As will be discussed in greater detail below, operation of the servomotor 248 (FIG. 1), and therefore movement of the pusher bars 174, is initiated in response to a signal received from the sensor 34 (FIG. 2). Cessation of operation of the servomotor 248, and, therefore, cessation of the movement of the pusher bars 174, is initiated in response to the signal from the sensor 278 (FIG. 1).

The servomotor 248 (FIGS. 1 and 2) is preferably programmable and has a power rating of at least 30 inch pounds of torque, and the capability of starting and stopping at a rate of about 10 times a second. As one specific example, a servomotor manufactured by Reliance Electrocraft as model number H4030P has proven to be very satisfactory.

Referring to FIGS. 7 and 9, operation of the servomotor 248 (FIGS. 1 and 2) causes the driven sprocket assemblies 198, 214, to rotate in unison so that the chain assemblies 208, 224 travel in unison about their respective paths. As a result, and because of the aforementioned manner in which the pusher bars 174*a*, 174*b*, 174*c*, 174*d* are mounted to the chain assemblies 208, 224, each of the pusher bars travel around their travel path while remaining in a generally upright configuration. Each of the pusher bars 174*a*, 174*b*, 174*c*, 174*d* travels in an identical manner around the sprocket assemblies of the pusher assembly 172. Therefore, the traveling characteristics of the pusher bar 174*a* are representative of the traveling characteristics of the other pusher bars 174*b*, 174*c*, 174*d*.

From the perspective of FIGS. 7 and 9, the chain assemblies 208, 224 travel in a counterclockwise direction so that the pusher bar 174*a* moves from the position in which it is illustrated to the position in which the pusher bar 174*b* is illustrated in solid lines, so as to move a stack 25 (FIG. 9) along the conveyor 160 (FIG. 9). The pusher bar 174*a* remains generally vertical while traveling from the position in which the pusher bar 174*a* is illustrated to the position in which the pusher bar 174*b* is illustrated in solid lines. The pusher bar 174*a* travels generally horizontally from the sprocket assemblies 202, 218 to the sprocket assemblies 204, 220. The travel path of the pusher bar 174*a* between the sprocket assemblies 204, 220 and the sprocket assemblies 206, 222 defines the angle "A" (FIG. 9) of approximately 15 degrees with respect to horizontal.

The travel path of the pusher bar 174*a* between the position in which the pusher bar 174*b* is illustrated in broken lines and a position just upstream from the position in which the pusher bar 174*c* is illustrated is generally vertical. Further, the pusher bar 174*a* remains generally vertical while traveling along the travel path between the position in which the pusher bar 174*b* is illustrated in solid lines and the position in which the pusher bar 174*c* is illustrated. The pusher bar 174*a* remains generally vertical and travels generally horizontally while moving from the position in which the pusher bar 174*c* is illustrated to the position in which the pusher bar 174*d* is illustrated. The pusher bar 174*a* remains generally vertical and travels generally vertically while moving from the position in which the pusher bar 174*d* is illustrated to the position in which the pusher bar 174*a* is illustrated.

The travel path of the pusher bar 174*a* is aligned with the slot 78 (FIG. 4) in the rear support plate 70 (FIG. 4), the opening 80 (FIG. 4) in the front support plate 72 (FIG. 4), and the slot 162 (FIG. 1) in the conveyor 162 (FIG. 1). Therefore, as the pusher bar 174*a* travels from the sprocket assemblies 200, 216 to the sprocket assemblies 202, 218, the upper end of the pusher bar 174*a* passes through the slot 162. As the pusher bar 174*a* travels around the sprockets 202, 218, the upper end of the pusher bar 174*a* passes through the slot 78. As the pusher bar 174*a* travels between the sprocket assemblies 202, 218 and the sprocket assemblies 206, 222, the pusher bar 174*a* extends through the slot 162 and the upper end of the pusher bar 174*a* remains above the upper surface of the conveyor 160, so that the pusher bar can push a stack 25 (FIGS. 2 and 9) along the conveyor 160. As the pusher bar 174*a* travels around the sprockets 206, 222, the upper end of the pusher bar 174*a*, and the stack 25 being pushed by the pusher bar 174*a*, pass through the opening 80 in the forward support plate 72. As the pusher bar 174*a* travels from the sprocket assemblies 206, 222 to the sprocket assemblies 198, 214, the pusher bar 174 descends below the conveyor 160.

Depending upon the size of the documents 20, it may be important that the contact face 179 (FIG. 8) of the pusher bar 174*a* defines the aforementioned 1 to 2 degree angle with respect to the conveyor 160 (FIG. 9) while the pusher bar 174*a* travels between the position in which the pusher bar 174*b* is illustrated in broken lines and the position in which the pusher bar 174*c* is illustrated. Likewise, in some circumstances, it is important that the pusher bar 174*a* travels at the aforementioned 15 degree angle with respect to the conveyor 160 between the sprocket assemblies 204, 220 and the sprocket assemblies 206, 222. These angular relationships seek to ensure that the pusher bar 174*a* does not obstruct a stack 25 being pushed along the upper surface of the conveyor 160 by the following pusher bar 174*b*.

The Coordinated Stacking and Conveying Operation

The general operations of the stacking machine 12 (FIGS. 1 and 2) and the conveying machine 14 (FIGS. 1 and 2) are described above. The coordinated operation of those machines 12, 14 will now be described. The coordinated operation is at least partially controlled by the control assembly within the control box 28 (FIG. 2). That control assembly may include a programmable logic controller (PLC) or another type of computer-based control system. That control assembly may alternatively include multiple relay-actuated switches, or the like. The control assembly within the control box 28 is preferably linked to the sensors 34 (FIG. 2), 101 (FIG. 4), 103 (FIG. 2), 166 (FIG. 2); the drive 23 (FIGS. 1 and 2); and the servomotors 106 (FIGS. 1, 2 and 4), 248 (FIGS. 1 and 2) to define a composite control assembly that coordinates the operation of the conveyor 22 ((FIGS. 1 and 2), the stacking machine 12 (FIGS. 1 and 2) and the conveying machine 14 (FIGS. 1 and 2) in the manner described below.

Referring to FIGS. 1 and 2, the conveyor 22 continuously sequentially provides documents 20 to the stacking machine 12. Referring primarily to FIGS. 4, 6A and 6B, the rotor assemblies 74*a*, 74*b* remain in the closed configuration until the sensor 34 (FIG. 1) detects that a predetermined number of documents 20 have passed the sensor 34, which is indicative of there being a stack 25 of documents 20 that has formed on the rotor assemblies.

The predetermined number of documents that triggers the sensor 34 (FIG. 1) is preferably programmed into the control system of the present invention, such as by being programmed into the programmable logic controller, or the like, that is within the control box 28 (FIG. 2). For example, if each of the stacks 25 is to include three documents 20, the control system may be programmed such that the signal from the sensor 34 is generated when the sensor 34 detects that a first document 20 of a set of three documents is passing the sensor 34. By initiating operation of the servomotor 106 in response to the sensor 34 viewing a first document of a set of three documents, the previous set of three documents will have had ample time to form into a stack 25 within the stacking compartment 146 (FIGS. 6A and 6B).

Referring to FIGS. 6A and 6B, in response to operation of the servomotor 106 being initiated by the signal from the sensor 34 (FIG. 1), the rotor assemblies 74*a*, 74*b* rotate 180 degrees in opposite directions so as to transition between an initial and a subsequent closed configuration. Each time the rotor assemblies 74*a*, 74*b* transition from one closed configuration to the next, the rotor assemblies pass through the open configuration so that a stack 25 is dropped upon the receiving area of the conveyor 160.

The above-discussed positioning of the rotor assemblies 74*a*, 74*b* in the closed configuration is partly achieved as a result of the operation of the servomotor 106 (FIGS. 1, 2 and 4) being ceased at the appropriate time. More specifically, the operation of the servomotor 106 is ceased when the sensor 101 (FIG. 4) detects that the rotors 74*a*, 74*b* have rotated 180 degrees, as discussed above.

Referring primarily to FIGS. 2, 6A, 6B and 9, the conveying machine 14 is in a "ready configuration" when two of the pusher bars 174 extend through the slot 162 (FIG. 1) of the conveyor 160, and those pusher bars are positioned on opposite sides of the receiving area defined on the upper surface of the conveyor 160. As specified above, the receiving area is the position at which stacks 25 are sequentially dropped onto the conveyor 160. For example, as illustrated in FIGS. 2 and 9, the pusher bar 174*a* is rearward of the receiving area and the pusher bar 174*b* is forward of the receiving area. As best shown in FIG. 2, when the conveying machine 14 is in the ready configuration, the contact face 179 (FIG. 7) of the pusher bar 174 just to the rear of the receiving area is coplanar with the inner surface of the rear support plate 70.

The pusher bars 174 positioned on the opposite sides of the receiving area remain stationary until shortly after the sensor 34 (FIG. 2) generates its signal, as discussed above. A brief delay period for actuating the conveying machine 14 (i.e., moving the pusher bars 174) is preferably programmed into the control system to allow the formed stack 25 to drop from the stacking mechanism 68 onto the receiving area before the pusher bars are set into motion. In response to a signal from the sensor 34, each of the pusher bars 174 move along their travel path a distance that is approximately equal to the length of the travel path divided by the number of pusher bars. For example, in the preferred embodiment where there are four pusher bars 174, the pusher bars travel approximately one fourth of the distance around the pusher bar's travel path each time a stack 25 is dropped from the stacking mechanism 68.

Referring to FIG. 9, the pusher bar 174*a* is positioned just behind and the pusher bar 174*b* positioned just forward of a stack 25 that has just been dropped. The pusher bar 174*a* can be characterized as being in a first position, the pusher bar 174*b* illustrated in solid lines can be characterized as being in a second position, the pusher bar 174*c* can be characterized as being in a third position, and the pusher bar 174*d* can be characterized as being in a fourth position along the pusher bar's travel path. In response to the dropping of the stack 25, the servomotor 248 (FIGS. 1 and 2) is briefly operated so that the pusher bars 174*a*, 174*b*, 174*c*, 174*d* each move to the next downstream position in their travel path. After the pusher bars 174*a*, 174*b*, 174*c*, 174*d* move to the next downstream position they remain stationary until the next stack 25 is dropped, at which time each of the pusher bars is moved to and temporarily held stationary at the next downstream position.

The above-discussed sequential advancement of the pusher bars 174 is partly achieved as a result of the operation of the servomotor 148 (FIG. 1) being ceased at the appropriate time. More specifically, the operation of the servomotor 248 is ceased when the sensor 278 (FIG. 1) detects that the cam 276 (FIG. 1) has rotated 360 degrees, as discussed above. The sequential advancement of the pusher bars 174 continues as long as stacks 25 are dropped to the conveying machine 14 (FIGS. 1 and 2).

The downstream end of the conveyor 160 may connect to the upstream end of another conveyor or other provisions may be made to remove stacks from the downstream end of the conveyor 160. For example, stacks 25 moved to the downstream end of the conveyor 160 may be moved to a conventional machine, such as a conventional trimming machine, for further processing.

Each of the sensors 103 and 166 (FIG. 2), the drive 23 (FIGS. 1 and 2), the servomotor 106 (FIGS. 1, 2 and 4) and the servomotor 248 (FIGS. 1 and 2) are responsive to the operation of the apparatus 10 (FIGS. 1 and 2) and the conveyor 22 (FIGS. 1 and 2) to shut off the apparatus 10 and the conveyor 22 if a jam of documents 20 (FIGS. 2, 6A, 6B, and 9) is likely to cause the apparatus 10 to become inoperative. Such a jam may occur, for example, if a user mistakenly attempts to cause the apparatus 10 to create stacks 25 (FIGS. 2, 6A, 6B and 9) larger than can be handled by the apparatus 10, or equipment downstream from the apparatus 10 is jammed. For example, if the drive 23 or one of the servomotors 106, 248 detects that it is operating at too high of a current, it will generate a signal that turns off the drive and the servomotors. Similarly, if the optical eye of the sensor 103 or the sensor 166 is blocked for longer than a predetermined period of time, the respective sensor 102, 166 will generate a signal that turns off the drive 23 and each of the servomotors 106, 248.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation. As an example, the term "document" as employed herein is intended to encompass any product of the type customarily processed by a machine of the described type, including single sheets of paper, folded sheets for signatures, and books.

What is claimed is:

1. An apparatus for processing documents that are sequentially provided to the apparatus, comprising:

a stacking assembly comprising:

a compartment capable of sequentially receiving the documents, a stacking mechanism forming the bottom of said compartment and including a pair of rotor assemblies mounted for rotation about parallel side by side horizontal axes, with each rotor assembly having at least one longitudinally and radially extending obstructing portion, and with said rotor assemblies being operative for rotation in opposite directions so that the obstructing portions are adapted to rotate into the compartment and stop to provide a closed configuration which is capable of supporting a stack of documents and to thereafter rotate so that the obstructing portions rotate downwardly to an open configuration wherein the compartment is open and the stack of documents is free to drop, and a drive assembly operative for repeatedly rotating said rotor assemblies in opposite directions to said closed configuration, then to said open configuration, and then back to said closed configuration, said drive assembly comprising a first programmable servo motor, and a conveyor assembly below said stacking assembly for sequentially receiving the stacks of documents dropped from said stacking assembly and conveying the received stacks to a remote location, said conveyor assembly comprising:

a support surface onto which the stacks are sequentially dropped from said stacking assembly, an endless conveyor proximate to said support surface and defining a conveyor circuit, a plurality of pusher members mounted in a spaced apart arrangement along said endless conveyor, and a conveyor drive assembly for sequentially advancing said endless conveyor a predetermined distance around said conveyor circuit such that upon each sequential advance one of said pusher members advances across said support surface to push away a stack that has been dropped on said support surface by said stacking mechanism, said conveyor drive assembly comprising a second programmable servo motor.

2. The apparatus of claim 1, wherein said pusher members are mounted to said endless conveyor so as to remain in an upright orientation during a complete cycle of said endless conveyor around said conveyor circuit.

3. The apparatus of claim 1, further comprising a sensor operative for generating a signal in response to determining that a predetermined number of documents have been introduced to said stacking assembly for the purpose of being stacked, and a control which is responsive to said signal for actuating said first and second servo motors such that said stacking mechanism cycles from said closed to said open configuration so that a stack is dropped from said stacking assembly to said support surface, and then advances one of said pusher members across said support surface to push away the dropped stack.

4. The apparatus of claim 1, wherein:

said endless conveyor comprises:

an endless first chain defining a first component of said conveyor circuit, and an endless second chain defining a second component of said conveyor circuit that is offset from said first circuit component;

said conveyor drive assembly, when operated, causes said first and second chains to travel around said first and second circuit components, respectively, in unison;

each of said pusher members is pivotally connected to both of said first and second chains, operative for moving along said conveyor circuit in response to operation of said conveyor drive assembly, and remains generally upright around the entirety of said conveyor circuit; and at least a portion of each of said pusher members moves from below to above said support surface prior to pushing a stack dropped onto said support surface by said stacking mechanism.

5. A conveying apparatus for moving documents that are sequentially provided to the conveying apparatus, comprising:

an endless conveyor defining a conveyor circuit;

a drive assembly for causing said endless conveyor to travel said conveyor circuit;

a support surface for supporting at least one of the documents; and a pusher member mounted to said endless conveyor so that said pusher member travels around said conveyor circuit, wherein said pusher member remains in a generally upright orientation while traveling around the entirety of said conveyor circuit, and while traveling around said conveyor circuit at least a portion of said pusher member moves from below said support surface to above said support surface, and thereafter moves along said support surface so that said pusher member is operative for pushing at least one of the documents upon said support surface, and wherein said movement of said pusher member from below said support surface to above said support surface occurs while said pusher member travels along a first segment of said conveyor circuit;

said movement of said pusher member along said support surface occurs while said pusher member travels along a second segment of said conveyor circuit that is downstream from said first segment;

said pusher member moves below said support surface while said pusher member travels along a third segment of said conveyor circuit that is downstream from said second segment;

a straight first subsection of said second segment of said conveyor circuit is generally parallel to said support surface; and a straight second subsection of said second segment of said conveyor circuit defines an acute angle with respect to said support surface.

6. The conveying apparatus of claim 5, wherein said pusher member comprises a face for contacting the documents, and said face is approximately perpendicular to said support surface while said pusher member travels along said first and second subsections of said second segment of said conveyor circuit.

7. The conveying apparatus of claim 5, wherein:

said pusher member is a first pusher member and the conveying apparatus further comprises a second pusher member pivotally mounted to said endless conveyor and displaced from said first pusher member along said conveyor circuit, and said second pusher member is operative for remaining in a generally upright orientation while traveling around the entirety of said conveyor circuit; and said drive assembly is operative for advancing said first and second pusher members around said conveyor circuit so that said first and second pusher members are located on opposite sides of a receiving area of said support surface when one of the sequentially provided documents is to be deposited on said receiving area.

8. The conveying apparatus of claim 7, wherein said drive assembly is further operative for temporarily holding said first and second pusher members stationary while said first and second pusher members are located on opposite sides of said receiving area.

9. The conveying apparatus of claim 5, wherein:

said endless conveyor comprises:

an endless first chain defining a first component of said conveyor circuit, which includes an upper run which is generally parallel to and below said support surface, and a lower run which is below and generally parallel to said upper run, and an endless second chain defining a second component of said conveyor circuit which includes an upper run which is generally parallel to and below said upper run of said first circuit component, and a lower run which is generally parallel to and below said lower run of said first circuit component, said drive assembly is operative to cause said first and second chains to travel said first and second circuit components, respectively, in unison; and the conveying apparatus further comprises means for interconnecting said pusher member to both of said first and second chains so that said pusher member travels said conveyor circuit in response to said first and second chains traveling said first and second circuits components, respectively, and said pusher member remains in an upright orientation.

10. The conveying apparatus of claim 9, wherein said pusher member is between said first chain and said second chain.

11. The conveying apparatus of claim 9, wherein said support surface defines an elongate slot through which said pusher member extends while said pusher member travels along said support surface.

12. The conveying apparatus of claim 9, wherein:

said pusher member is elongate and generally straight; and the means for interconnecting said pusher member to said first and second chains comprises:

a first shaft that is generally straight, wherein said first shaft extends and is pivotally connected between said first chain and said pusher member, and a second shaft that is generally straight, wherein said second shaft extends and is pivotally connected between said second chain and said pusher member.

13. The conveying apparatus of claim 12, wherein:

said pusher member defines a first opening and a second opening that is displaced along the length of said pusher member from said first opening;

said first shaft includes a first end mounted to said first chain and an opposite second end pivotally mounted within said first opening; and said second shaft includes a first end mounted to said second chain and an opposite second end pivotally mounted within said second opening.

14. A stacking apparatus for stacking documents that are sequentially provided to the stacking apparatus, comprising:

a compartment for receiving the documents;

a stacking mechanism forming the bottom of said compartment and including a pair of rotor assemblies mounted for rotation about parallel side by side horizontal axes, with each rotor assembly having at least one longitudinally and radially extending obstructing portion, and with said rotor assemblies being operative for rotation in opposite directions so that the obstructing portions are adapted to rotate into the compartment and stop to provide a closed configuration which is capable of supporting a stack of documents and to thereafter rotate so that the obstructing portions rotate downwardly to an open configuration wherein the compartment is open and the stack of documents is free to drop, and a drive assembly operative for repeatedly rotating said rotor assemblies in opposite directions to said closed configuration, then to said open configuration, and then back to said closed configuration, said drive assembly comprising a programmable servo motor.

15. The stacking apparatus of claim 14, wherein each rotor assembly has a first and a second of said obstructing portions which extend in opposite directions, and wherein from a single frame of reference, a first of said rotor assemblies is rotated approximately 180 degrees counterclockwise and a second of said rotor assemblies is rotated approximately 180 degrees clockwise between an initial occurrence of said closed configuration and a subsequent occurrence of said closed configuration.

16. The stacking apparatus of claim 15, wherein:

said first obstructing portion of said first rotor assembly extends in a first plane; and said second obstructing portion of said first rotor assembly extends in a second plane that is distant from and generally parallel to said first plane.

17. The stacking apparatus of claim 15, further comprising a sensor for providing a signal when a predetermined number of documents are introduced to said compartment, wherein said drive assembly cycles said rotor assemblies from said closed configuration to said open configuration in response to said signal.

18. The stacking apparatus of claim 15, wherein:

said first of said rotor assemblies comprises a longitudinally extending first shaft;

each of said obstructing portions of said first rotor assembly comprises a plurality of fingers connected to said first shaft, spaced longitudinally along said first shaft, and extending generally radially from said first shaft in a common plane;

said second of said rotor assemblies comprises a longitudinally extending second shaft;

each of said obstructing portions of said second rotor assembly comprises a plurality of fingers connected to said second shaft, spaced longitudinally along said second shaft, and extending generally radially from said second shaft in a common plane; and the stacking apparatus further comprises first and second guide partitions that at least partially define said compartment, wherein said first guide partition defines a plurality of slots through which said fingers of said first rotor assembly pass in response to rotation of said first rotor assembly, and said second guide partition defines a plurality of slots through which said fingers of said second rotor assembly pass in response to rotation of said second rotor assembly.

19. The stacking apparatus of claim 15, wherein rotation of said rotor assemblies is coordinated so that as said rotor assemblies are rotated in said opposite directions:

said first obstructing portions rotate in unison downward through said compartment and toward one another, and then both of said first obstructing portions extend generally in a common plane to define said obstructing configuration;

said first obstructing portions rotate in unison downward and away from one another and said compartment to define said open configuration;

said second obstructing portions rotate in unison downward through said compartment and toward one another, and then both of said second obstructing portions extend generally in said common plane to define said obstructing configuration; and said second obstructing portions rotate in unison downward and away from one another and said compartment to define said open configuration.

20. A conveying apparatus for moving documents that are sequentially provided to the conveying apparatus, comprising:

an endless conveyor defining a conveyor circuit;

a drive assembly for causing said endless conveyor to travel said conveyor circuit, said drive assembly comprising a programmable servo motor;

a support surface for supporting at least one of the documents; and a pusher member mounted to said endless conveyor so that said pusher member travels around said conveyor circuit, wherein said pusher member remains in a generally upright orientation while traveling around the entirety of said conveyor circuit, and while traveling around said conveyor circuit at least a portion of said pusher member moves from below said support surface to above said support surface, and thereafter moves along said support surface so that said pusher member is operative for pushing at least one of the documents along said support surface.

21. The conveying apparatus of claim 20, wherein:

said endless conveyor comprises:

an endless first chain defining a first component of said conveyor circuit, which includes an upper run which is generally parallel to and below said support surface, and a lower run which is below and generally parallel to said upper run, and an endless second chain defining a second component of said conveyor circuit which includes an upper run which is generally parallel to and below said upper run of said first circuit component, and a lower run which is generally parallel to and below said lower run of said first circuit component, said drive assembly is operative to cause said first and second chains to travel said first and second circuit components, respectively, in unison; and the conveying apparatus further comprising means for interconnecting said pusher member to both of said first and second chains so that said pusher member travels said conveyor circuit in response to said first and second chains traveling said first and second circuit components, respectively, and said pusher member remains in said generally upright orientation.

* * * * *